US006955277B2

(12) United States Patent
Smith et al.

(10) Patent No.: US 6,955,277 B2
(45) Date of Patent: Oct. 18, 2005

(54) DISPENSING DEVICE AND METHOD

(76) Inventors: Eric W. Smith, P.O. Box 1178, Mars, PA (US) 16046; Homer D. Libengood, 1984 Oaks Point Rd., Blairsville, PA (US) 15717

( * ) Notice: Subject to any disclaimer, the term of this patent is extended or adjusted under 35 U.S.C. 154(b) by 0 days.

(21) Appl. No.: 10/804,892

(22) Filed: Mar. 19, 2004

(65) Prior Publication Data

US 2005/0205599 A1 Sep. 22, 2005

(51) Int. Cl.[7] ..... B67D 5/60
(52) U.S. Cl. ..... 222/145.5; 222/1; 222/145.6
(58) Field of Search ..... 222/1, 145.5, 145.6, 222/145.1, 137, 135, 325–327; 366/12, 170.1, 366/175.1

(56) References Cited

U.S. PATENT DOCUMENTS 3,989,228 A * 11/1976 Morris et al. ..... 366/159.1
4,030,637 A * 6/1977 Boden et al. ..... 222/137
4,117,551 A * 9/1978 Brooks et al. ..... 366/162.1
4,129,145 A * 12/1978 Wynn ..... 137/541
4,549,676 A * 10/1985 Gerich ..... 222/145.6
5,092,492 A * 3/1992 Centea ..... 222/137
5,225,168 A * 7/1993 Khosla ..... 422/135
5,333,760 A 8/1994 Simmen
5,342,149 A * 8/1994 McCabe et al. ..... 405/269
5,443,183 A * 8/1995 Jacobsen et al. ..... 222/145.6
5,477,987 A 12/1995 Keller
5,615,949 A * 4/1997 Morano et al. ..... 366/159.1
5,639,219 A * 6/1997 Conatser ..... 417/53
6,029,857 A * 2/2000 Keller ..... 222/137
6,034,147 A * 3/2000 Radovich et al. ..... 521/130
6,241,125 B1 6/2001 Jacobsen et al.

* cited by examiner

*Primary Examiner*—Frederick Nicolas
(74) *Attorney, Agent, or Firm*—Jon M. Lewis

(57) ABSTRACT

A dispensing device and method, especially adapted for use in sealing high pressure fluid leaks, is disclosed. Such use requires high pressure dispensing of sealant. Such sealants are formed by an exothermic reaction of at least two liquid substances that generates high pressures within the dispensing device. Such pressures could potentially harm the feeding system of the device due to pressure backflow. This problem is solved by providing a check valve in the mixing and reaction chamber of the device to protect the feeding system. A static mixer is disposed within the chamber to enhance mixing and reaction of the substances.

11 Claims, 3 Drawing Sheets

DISPENSING DEVICE AND METHOD

FIELD OF INVENTION

This invention relates to a dispensing device and method for dispensing a reaction product formed through reaction of at least two substances that generates a gas, which is capable of creating sufficiently high pressure to damage the device. The use of a check valve located at the end of the mixing and reaction chamber opposite to the dispensing end of such chamber, serves to prevent backflow pressure from damaging the device.

The device and its method of operation are especially adapted for use for severe dispensing and sealing applications where high dispensing pressures are required. Such severe applications include, but are not limited to, sealing pressurized gas and water leaks.

BACKGROUND OF THE INVENTION

Dispensing devices requiring mixing of at least two substances prior to dispensing are known in the art. These devices dispense a variety of pasty or highly viscious products including adhesives, joint fillers, foams, sealants, grouts, molding compounds, etc. The dispensed products are typically formed by mixing at least two previously separated substances to form a reaction product which is then dispensed from the device. The respective substances may be passed or pushed through a static mixer located within the device to facilitate mixing and thereby reaction. The reaction product is then dispensed through the dispensing end of the device to accomplish a desired application.

Typical of such prior art devices is that illustrated in U.S. Pat. No. 5,333,760. This patent discloses a cartridge mixing and dispensing device that is widely used. However, this device is not suitable for use when high-pressure build-up and pressure backflow occurs in the device due to gas generation during the reaction of the respective substances. Such build-up and backflow may result in bending or other types of damage to the dispensing device.

When a desired dispensing application requires the use of a reaction product that is produced by a reaction that creates high pressures in the device, i.e., on the order of 45 psi or higher, the device may be damaged. Pressure build-up occurs once the reaction product commences exit from the device because the product exit seals the dispensing means or exit orifice. Such pressure build-up can then result in undesirable pressure backflow into the feeding system of the dispensing device once feeding ceases. The present invention solves the above problem in an efficient and effective manner by providing a check valve at the end of the mixing and reaction chamber opposite the dispensing end of the chamber. A check valve affords a convenient mode of preventing back pressure that could damage the feeding system of the device.

U.S. Pat. No. 6,241,125 discloses an overall system of variable connections for the application of several materials. A check valve is indicated in FIG. 3 of the patent as a component of the packer assembly. Such check valves are common for such assemblies. However, no check valve is used within the mixing and reaction portion of the assembly.

U.S. Pat. No. 5,477,987 illustrates a pump system that incorporates check valves in its output side. These valves function to prevent the respective materials from cross contamination. Again, such check valves are not associated with the mixing and reaction portion of the device.

SUMMARY OF THE INVENTION

The present invention relates to a dispensing device for products resulting from mixing and reacting at least two liquid substances with each other. One of the reaction products is a gas that causes potentially harmful pressures within the device that could create a backflow pressure capable of causing damage to a portion of the device. The device comprises an elongated sheath, which forms an essentially closed mixing, and reaction chamber, a dispensing orifice located at one end of the sheath, and a check valve located at an end of the sheath opposite to the dispensing orifice. The check valve is in an essentially sealed relationship with the sheath and serves to prevent backflow from the gas and chemical mixture into a feeding system. The check valve has at least one opening to admit the substances from the feeding system. The substances pass through an interior portion of the check valve and then through an exit opening into a mixing and reaction chamber of the device. The check valve utilizes a closing element to close the exit opening upon ceasing of feeding the substances and the creation of backflow pressure within the chamber, thereby preventing damage to the feeding system and cross contamination of the contents remaining in the tubes. A static mixer located in the chamber between the dispensing orifice and check valve is used to mix and enhance the reaction of the substances. A feeding system is connected to the check valve for feeding the substances into the outer end of the check valve.

The present invention also involves a method for dispensing a reaction product formed from the reaction of at least two substances. The method involves feeding the substances from a feeding system into a check valve which is located at an end of a mixing and reaction chamber of a dispensing device. The substances then pass through the check valve and enter the chamber where the substances become mixed by a static mixer and react with each other to form a reaction product which includes a gas. Gas product creates a pressure within the chamber upon dispensing of the product from the device. Once feeding of the substances ceases, the pressure created within the reaction chamber causes the check valve to close and thereby prevents backpressure from damaging the feeding system of the device.

A prime application for the invention is utilizing the device and method for difficult sealing processes where high-pressure fluid leaks occur, such as gas or water leaks. Once the check valve closes, the dispensing pressure is maintained, or even increased, thereby further assisting the sealing operation.

DETAILED DESCRIPTION OF THE INVENTION

Figure 1:
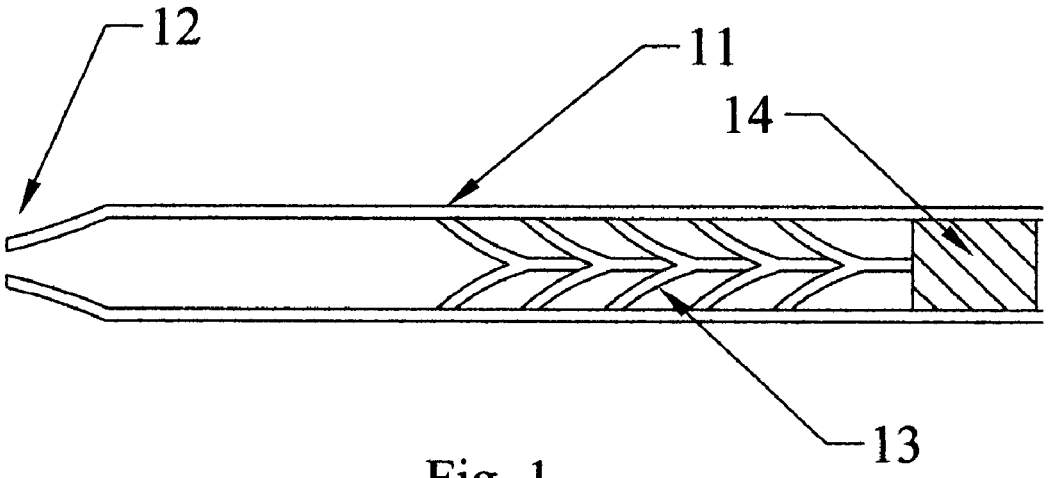
FIG. 1 is a cross-sectional view of a portion of the dispensing device that does not include the feeding system.

A portion of the dispensing device of the invention is illustrated in cross-section in FIG. 1. Sheath 11 forms an essentially sealed cylindrical mixing and reaction chamber to receive at least two substances, to mix the substances, to permit reaction of the substances, and to dispense the reaction product through dispensing orifice 12 for a given application. Static mixing element 13 is contained within the chamber. Plug-like check valve 14 is contained within and located at the end of the chamber opposite to the chamber end having dispensing orifice 12. In operation, at least two substances are fed into, pass through, and exit from check valve 14 into the chamber. While passing through the chamber, the substances are mixed by static mixing element 13 and react to form reaction products; for example, cured polyurethane and a carbon dioxide gas. The product is dispensed from dispensing orifice 12, and the gas builds pressure within the chamber once initial passage of the product seals dispensing orifice 12. Once feeding of the substances is completed, the gas, because of backpressure created by the reaction and sealing of the dispensing orifice 12, would back flow into the feeding system and cause damage and cross contamination to such system unless otherwise prevented. However, check valve 14 closes due to such backflow and thus protects the feeding system from potential damage and cross contamination.

Figure 2:
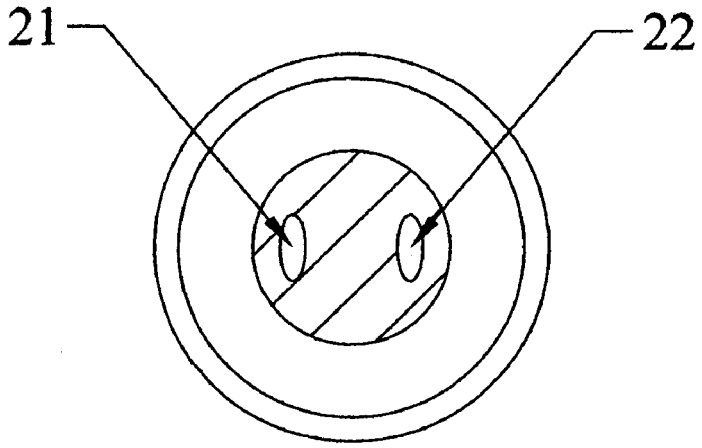
FIG. 2 is an end view of a check valve. Such view illustrates the end of the check valve furthest removed from the interior of the mixing and reaction chamber of the device.

FIG. 2 illustrates the end of the check valve. Holes 21 and 22 permit entry of substances from the feeding system (not shown in this Figure) into the check valve where the substances pass through the check valve and exit into the chamber of the device.

Figure 3:
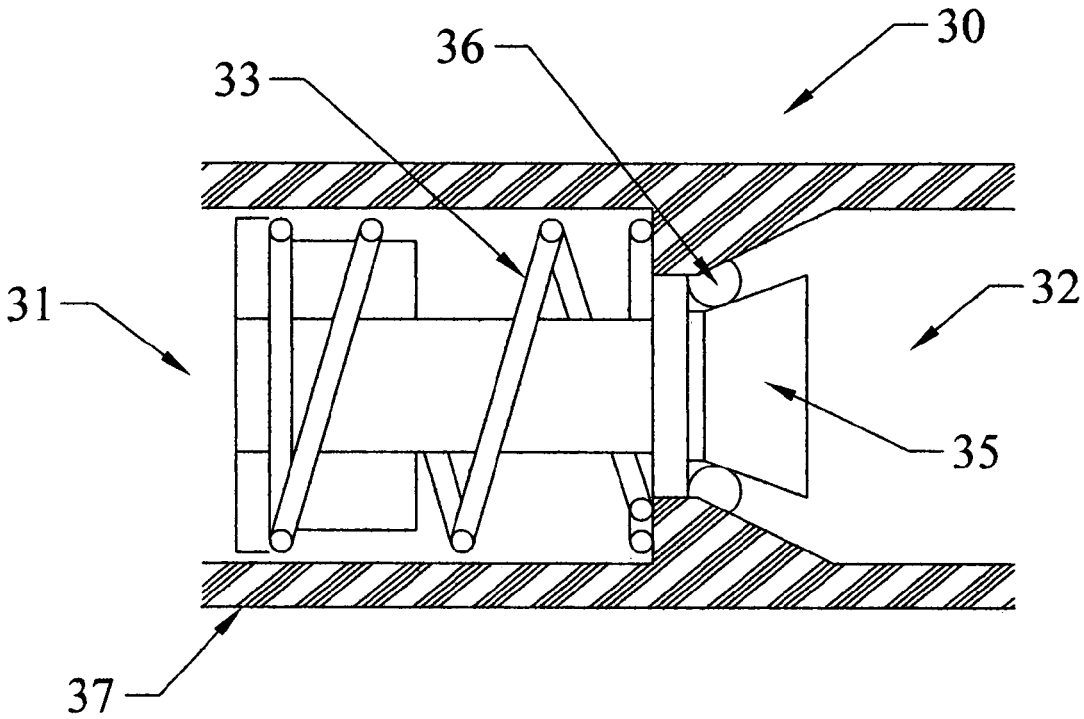
FIG. 3 is a cross-sectional view of the check valve illustrating the exit opening in the valve, which permits passage of the substances into the mixing and reaction chamber of the device.

FIG. 3 is a cross-sectional view of a check valve suitable for use in the invention. The substances are admitted into opening 31 of the check valve and pass into the reaction chamber through exit opening 32. The check valve is in the closed position.

During operation of the device and while the check valve is in the open position and secured to the ends of the two tubes by a nut (not shown), two liquids are expelled from the feeding tubes (not shown) and are forced into the rear portion 37 of check valve 30. The liquids push valve stem 35 forward in the direction of flow. Check valve 30 may be held in place in the mixing and reaction chamber by crimping the back portion of the mixing and reaction chamber. Rather than crimping the back portion of the mixing and reaction chamber, the check valve may be dimensioned so that an interference fit is obtained when the check valve is inserted into the interior of the mixing and reaction chamber. An adhesive between the respective members may be used to further secure the check valve in the mixing and reaction chamber. Such action compresses spring 33 and unseats captive O-ring 36, simultaneously as the forward portion of stem 35 moves in the direction of flow, the orifice positioned immediately behind O-ring 36. This permits the liquid substances to flow into and through the static mixer assembly toward the dispensing end. The check valve remains in its open position as long as the flow of the substances continues.

When the dispension of the reacted substances ceases, residual substances in the mixer begin to react. Such reaction commences at the output end of the mixer, where the substances have become the most thoroughly mixed. Because flow from the tubes has ceased, the spring 33 in the check valve has returned valve stem 35 and captive O-ring 36 to their original closed positions, thereby closing the orifice and sealing any return flow with O-ring 36). As the reaction of the residual substances continues, pressurized gas ($CO_2$, for example) exerts further pressure against valve stem 35 to hold it in the closed position. This operation effectively protects the gun mechanism from reverse motion and thus prevents damage to the mechanism and also prevents backflow of mixed substances into the separate feed tubes and prevents cross contamination of the materials contained in the feed tubes.

The check valve illustrated in FIG. 3 corresponds to Model 130-140 of a cartridge check valve, which is commercially available from Smart Products Incorporated, 1710 Ringwood Avenue, San Jose, Calif. As would be understood by one skilled in the art, other cartridge check valves, including Model 110-120 of Smart Products Incorporated, could be used in the invention. Also, other types of check valves, such as swing check valves, lift check valves, tilting-disk check valves, and the like, could be employed in the present invention.

Figure 4:
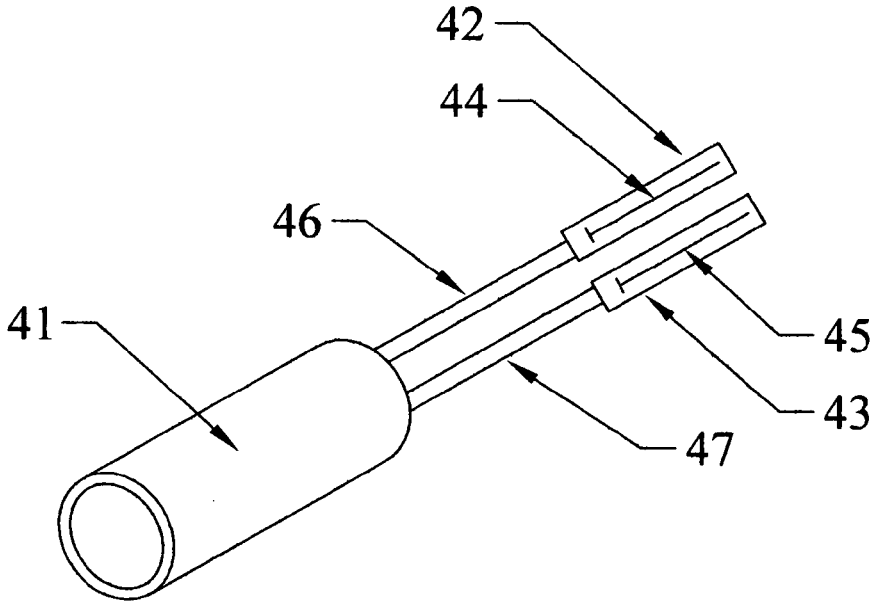
FIG. 4 generally illustrates the check valve being connected to a feeding system.

FIG. 4 is a schematic illustration of check valve 41 connected to a feed system. The feed system cartridges 42 and 43, which contain the substances to be mixed and reacted in the chamber of the device. The respective substances may be conveniently expelled or pushed from cartridges 42 and 43 with piston-like elements 44 and 45 into feed lines 46 and 47 and then into check valve 41. The feeding device is not illustrated in further detail because it is conventional. Moreover, there are a variety of other conventional systems that would be understood by one skilled in the art to be useful for the dispensing device of the invention. Such systems include, but are not limited to, piston pump systems, pressurized vessel systems, gravity feed tank systems, and hand pump systems.

The method of operation of the dispensing device of the invention has been described in connection with the above discussion of FIGS. 1–4.

Cured polyurethane reaction products are an example of a dispensed product that is capable of sealing high-pressure fluid leaks, such as gas or water. Such materials have been utilized previously for foamed roofing systems, but to Applicant's knowledge, not for this specific application of the present invention. In this instance, polymethylene polyphenyl isocyanates and a curing agent, 4,4diphenymethane diisocyanate, are fed into a check valve, passed into a mixing and reaction chamber, and dispensed as cured polyurethane into a crack, crevice, hole, void, separation, etc., where the leak occurs. The high-pressure dispension serves to block or seal the leak. The reaction is highly explosive and generates (due to $CO_2$ formation) internal pressures on the device on the order of 45 psi and higher.

Other substances that may be used in the invention include, but are not limited to single component systems such as prepolymeric polyurethanes with a combined catalyst.

The invention is especially suitable for use in leaks that are difficult, if not impossible, to seal with other types of devices. Examples of such difficult sealing applications are water leaks up to about 150 gallons per minute or higher. Typically, the invention is useful for sealing leakages from about 5 to about 150 gallons per minute. Such leaks are typically encountered in manhole repairs; "cold" joints in concrete; cement-to-rubber gaskets; cracks in cement foundations and slurry walls; failed water stop joints in dams, tunnels, subways, etc.; mining roof support bolts; failed joints in intake towers on reservoirs; leaking concrete bulkheads; basements; and rock interfaces, and the like.

Figure 5:
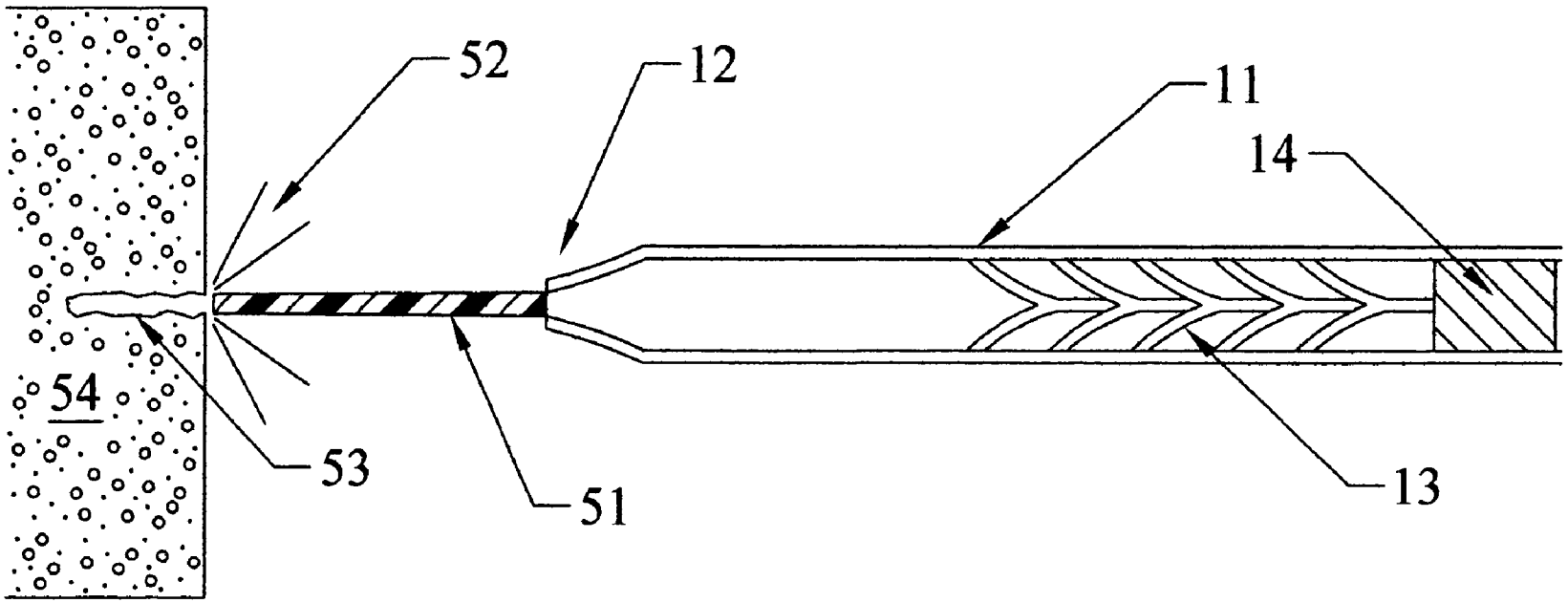
FIG. 5 is a cross-sectional view generally illustrating the use of the device of FIG. 1 to seal a water leak.

FIG. 5 is a cross-sectional view illustrating the use of the device of FIG. 1 to seal a water leak. Cured polyurethane product 51 is dispensed from dispensing orifice 12 into water leak 52 to seal such leak. Water leak 52 may be up to about 150 gallons per minute or higher. Water leak 52 is shown as occurring from crack 53 in cement foundation 54 to illustrate a typical sealing application.

It is claimed:

1. A device for dispensing a product resulting from mixing at least two liquid substances that react with each other upon contact to create gas and to thereby create a pressure that would cause a gas backflow pressure capable of causing damage to a portion of said device, said device comprising:

(a) an elongated sheath forming an essentially closed mixing and reaction chamber;

(b) a dispensing orifice located at an end of said sheath for dispensing said product;

(c) a check valve in essentially sealed relationship within said sheath, being secured to said sheath, and located at an end of said sheath opposite to said dispensing orifice for preventing backflow of said gas, said check valve having at least two admitting openings to admit said liquid substances from a feeding system, an open interior portion for passing said substances through said check valve, and at least one exit opening to permit said substances to pass into said chamber, said check valve further comprising a closing element to close said exit opening upon creation of backflow pressure within said chamber thereby preventing damage to said feeding system, said closing element comprising a rod having a shaft and closing end, said rod axially moved due to pressure created within said check valve whereby said closing end is being moved to close said check valve against back pressure created within said mixing and reaction chamber;

(d) a static mixer for mixing said substances and located within said chamber between said dispensing orifice and said check valve; and (e) a feeding system connected to said check valve for feeding said substances into said check valve.

2. The device of claim 1, wherein said check valve has a round cross section and is dimensioned so that an interference fit is obtained when said check valve is inserted into said elongated sheath and secured to said elongated sheath.

3. The device of claim 1, wherein said check valve is secured by an adhesive.

4. The device of claim 1, wherein said check valve is secured by crimping a back portion of said elongated sheath.

5. A method of dispensing a reaction product comprising cured polyurethane formed from reaction of least two liquid substances, said liquid substances comprising polymethylene polyphenyl isocyanate and 4,4 diphenymethane diisocyanate as a curing agent, comprising the steps of:

(a) feeding at least said two liquid substances from a feeding system into a check valve located at an end of a mixing and reaction chamber of a dispensing device, said device comprising:

(i) an elongated sheath forming an essentially closed mixing and reaction chamber;

(ii) a dispensing orifice located at an end of said sheath for dispensing said product;

(iii) a check valve in essentially sealed relationship within said sheath, being secured to said sheath, and located at an end of said sheath opposite to said dispensing orifice for preventing backflow of said gas, said check valve having at least two admitting openings to admit said substances from a feeding system, an open interior portion for passing said substances through said check valve, and at least one exit opening to permit said substances to pass into said chamber, said check valve further comprising a closing element to close said exit opening upon creation of backflow pressure within said chamber thereby preventing damage to said feeding system, said closing element comprising a rod having a shaft and closing end, said rod axially moved due to pressure created within said check valve whereby said closing end is being moved to close said check valve against back pressure created within said mixing and reaction chamber; and (iv) a static mixer for mixing said substances and located within said chamber between said dispensing orifice and said check valve;

(b) passing said liquid substances through said check valve and into said chamber where said substances are mixed and react with each other to form said polyurethane and including a gas, thereby creating an internal pressure on the order of 45 psi and higher within said chamber;

(c) dispensing said product from said device;

(d) ceasing feeding said substances into said check valve and said chamber, whereby a back pressure is created in said chamber;

(e) preventing said back pressure from entering into said feeding system, and thereby avoiding damaging said system by closing said check valve, said check valve being closed due to said back pressure; and (f) continuing to dispense said reaction product.

6. The method of claim 5 further comprising dispensing said cured polyurethane into a water leak to seal said leak.

7. The method of claim 6, wherein said leak is up to about 150 gallons per minute or higher.

8. The method of claim 7, wherein said leak is from about 5 to about 150 gallons per minute.

9. The method of claim 5, wherein said check valve has a round cross section and is dimensioned so that an interference fit is obtained when said check valve is inserted into said elongated sheath and secured to said elongated sheath.

10. The method of claim 5, wherein said check valve is secured by an adhesive.

11. The method of claim 5, wherein said check valve is secured by crimping a back portion of said elongated sheath.

* * * * *